US006960748B2

(12) United States Patent
Baker

(10) Patent No.: US 6,960,748 B2
(45) Date of Patent: Nov. 1, 2005

(54) COLLAPSIBLE MICROWAVE POPCORN BOX

(75) Inventor: Mark Baker, Fort Wayne, IN (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 19 days.

(21) Appl. No.: 10/682,139

(22) Filed: Oct. 9, 2003

(65) Prior Publication Data

US 2005/0077291 A1 Apr. 14, 2005

(51) Int. Cl.[7] ..... H05B 6/80

(52) U.S. Cl. ..... 219/725; 219/727; 219/728; 426/107; 426/234; 99/DIG. 14

(58) Field of Search ..... 219/725, 727, 219/728, 729, 734, 735; 426/107, 234, 113, 243, 111, 118; 99/DIG. 14; 156/275.7, 293; 229/242, 245; 220/912

(56) References Cited

U.S. PATENT DOCUMENTS

| | | | | |
|---|---|---|---|---|
| 3,311,285 | A | | 3/1967 | Korr |
| 3,483,358 | A | | 12/1969 | Eisler |
| 3,865,301 | A | | 2/1975 | Pothier et al. |
| 3,891,775 | A | | 6/1975 | Murray et al. |
| 4,038,425 | A | | 7/1977 | Brandberg et al. |
| 4,100,302 | A | | 7/1978 | Theimer et al. |
| 4,453,665 | A | | 6/1984 | Roccaforte et al. |
| 4,505,961 | A | | 3/1985 | Lu |
| 4,553,010 | A | | 11/1985 | Bohrer et al. |
| 4,555,605 | A | | 11/1985 | Brown et al. |
| 4,567,341 | A | | 1/1986 | Brown |
| 4,584,202 | A | * | 4/1986 | Roccaforte ..... 426/111 |
| 4,592,914 | A | | 6/1986 | Kuchenbecker |
| 4,596,713 | A | | 6/1986 | Burdette |
| 4,626,641 | A | | 12/1986 | Brown |
| 4,640,838 | A | | 2/1987 | Isakson et al. |
| 4,678,882 | A | | 7/1987 | Bohrer et al. |
| 4,734,288 | A | * | 3/1988 | Engstrom et al. ..... 426/107 |
| 4,745,249 | A | | 5/1988 | Daniels |
| 4,861,957 | A | | 8/1989 | Welles |
| 4,861,958 | A | | 8/1989 | Bohrer et al. |
| 4,883,936 | A | | 11/1989 | Maynard et al. |
| 4,890,439 | A | | 1/1990 | Smart |
| 4,951,824 | A | | 8/1990 | Kuchenbecker et al. |
| 4,972,058 | A | | 11/1990 | Benson et al. |
| 4,973,810 | A | | 11/1990 | Brauner |
| 4,982,064 | A | | 1/1991 | Hartman et al. |
| 4,992,636 | A | | 2/1991 | Namiki et al. |
| 5,012,068 | A | | 4/1991 | Anderson |

(Continued)

FOREIGN PATENT DOCUMENTS

| | | |
|---|---|---|
| EP | 0487166 A1 | 5/1992 |
| EP | 0563442 B1 | 10/1993 |
| WO | WO 91/09791 | 7/1991 |
| WO | WO 91/10339 | 7/1991 |
| WO | WO 91/15096 | 10/1991 |
| WO | WO 92/00358 | 1/1992 |
| WO | WO 92/20199 | 7/1992 |
| WO | WO/9211740 | 11/1992 |
| WO | WO 97/11740 | 4/1997 |

*Primary Examiner*—Quang T. Van
(74) *Attorney, Agent, or Firm*—Armstrong Teasdale LLP

(57) ABSTRACT

A collapsible cooking container formed from a generally, rectangularly shaped paperboard blank folded along crease lines so as to have a bottom portion, a first side portion, a top portion, and a second side portion wherein the top portion and the first side portion are adapted to be attached to form a cube having opposed, open sides. The opposed, open sides are substantially covered when the collapsible cooking container is in an expanded condition by segments provided to the bottom portion, first and second side portions, and top portion that cooperate to form first and second collapsible sides.

15 Claims, 4 Drawing Sheets

U.S. PATENT DOCUMENTS 5,044,777 A 9/1991 Watkins et al.
5,045,330 A 9/1991 Pawlowski
5,049,710 A 9/1991 Prosise et al.
5,049,714 A 9/1991 Beresniewicz et al.
5,059,279 A 10/1991 Wilson
5,078,273 A 1/1992 Kuchenbecker
5,085,323 A 2/1992 Kuchenbecker et al.
5,103,980 A 4/1992 Kuchenbecker
5,107,089 A 4/1992 Beresniewicz et al.
5,132,144 A 7/1992 Parks
5,167,606 A 12/1992 Kuchenbecker
5,171,594 A 12/1992 Babbitt
5,177,332 A 1/1993 Fong
5,189,272 A 2/1993 McDonald et al.
5,217,765 A 6/1993 Parks
5,231,268 A 7/1993 Hall et al.
5,247,149 A 9/1993 Peleg
5,252,793 A 10/1993 Woods
5,308,945 A 5/1994 VanHandel et al.
5,326,576 A 7/1994 Zuege
RE34,682 E 8/1994 Maynard et al.
5,357,006 A 10/1994 Gassan et al.
5,357,086 A 10/1994 Turpin et al.
5,369,256 A 11/1994 Woods
5,370,883 A 12/1994 Saunier
RE34,829 E 1/1995 Stone
5,389,767 A 2/1995 Dobry
5,399,366 A 3/1995 Geddes et al.
5,405,663 A 4/1995 Archibald et al.
5,410,135 A 4/1995 Pollart et al.
5,424,517 A 6/1995 Habeger, Jr. et al.
5,454,471 A 10/1995 Norvell
5,464,969 A 11/1995 Miller
5,468,939 A * 11/1995 MacLean, IV ..... 219/727
5,474,383 A 12/1995 Zuege et al.
5,488,220 A 1/1996 Freerks et al.
5,514,854 A 5/1996 Atsaves
5,519,195 A 5/1996 Keefer et al.
5,523,549 A 6/1996 Tenzer
5,565,125 A 10/1996 Parks
5,571,627 A 11/1996 Perry et al.
5,614,259 A 3/1997 Yang et al.
5,726,426 A 3/1998 Davis et al.
5,773,801 A 6/1998 Blamer et al.
5,871,790 A 2/1999 Monier et al.
5,985,343 A 11/1999 Hasse, Jr. et al.
5,994,685 A 11/1999 Jackson et al.
6,005,234 A 12/1999 Moseley et al.
6,063,415 A 5/2000 Walters
6,100,513 A 8/2000 Jackson et al.
6,126,976 A 10/2000 Hasse, Jr. et al.
6,137,098 A 10/2000 Moseley et al.
6,168,812 B1 1/2001 Paulucci
6,188,055 B1 2/2001 Walters
6,231,903 B1 5/2001 Ji et al.
6,320,172 B1 11/2001 Watkins
6,396,036 B1 5/2002 Hanson
2001/0001674 A1 5/2001 Simpson et al.
2002/0043523 A1 4/2002 Watkins
2002/0102334 A1 8/2002 Edomwonyi
2003/0106899 A1 * 6/2003 Langen ..... 220/912

* cited by examiner

COLLAPSIBLE MICROWAVE POPCORN BOX

BACKGROUND OF THE INVENTION

1. Field of the Invention

This invention generally relates to microwave cooking containers and, more particularly, to a collapsible/expandable box for popping popcorn in a microwave oven.

2. Prior Art

As is known in the art, microwave ovens radiate electromagnetic energy waves in short radio frequencies which are distributed randomly throughout the microwave oven until absorbed by a food product being heated. To permit the interior of the food product to be heated through the direct absorption of microwaves, microwave cooking containers are generally transparent to microwave energy. Specifically, the food product is heated since the microwaves cause water molecules within the food product to oscillate at a high frequency and the resulting molecular friction generates heat. In the case where microwaves are utilized to directly heat a high moisture food product, the heating temperature is generally limited to about 100° C. at which point the water content within the food product begins to vaporize. Upon reaching vaporization, the water molecules will move through the food product and disburse in the ambient atmosphere where a portion condenses on the surface of the food product. Undesirably, this process precludes browning or crisping of the food product as it is being heated and, furthermore, may make the food product soggy.

For the purpose of elevating the heating temperature above 100° C., it is also well known in the art to provide microwave cooking containers with a microwave energy absorbing material, commonly referred to as a susceptor. Commonly, susceptors are located in the lower end of the container containing the food product and function to heat the food product by conduction and radiation. By way of example, U.S. Pat. No. 4,553,010 discloses a partially collapsible, microwave food container having a susceptor integrated with the bottom of the food container. Microwave cooking containers having integrated susceptors are not, however, wholly satisfactory since the heat generated by susceptors may present a safety hazard to users, particularly when a user is withdrawing the heated food product container from the microwave oven. Furthermore, integrated susceptors may radiate heat unevenly resulting in hot spots that can cause the container and/or the food product to overheat. Overheating of the food product is undesirable as it tends to dry-out and/or overcook the food product.

To provide for the popping of popcorn in a microwave oven, it is further known to provide a microwave cooking container that comprises a bag or pouch containing un-popped popcorn and hydrogenated cooking fat. In addition, the bag or pouch has a susceptor integrated into its bottom that becomes heated as it absorbs microwave radiation. In this manner, the susceptor and the direct microwave energy cooperate to pop the popcorn as the susceptor conducts heat upwardly into the popcorn kernels while water stored in the kernels is caused to vaporize until such time as the internal pressure is sufficient to explosively rupture the outer shell or pericarp of the popcorn kernel. The bag or pouch is constructed to permit expansion under the influence of the internal vapor pressure to accommodate the increase in volume as the popcorn pops.

Still further, it is known to provide a microwave cooking container that comprises a collapsible box for use in popping popcorn. By way of additional example, U.S. Pat. No. 5,486,939 discloses a collapsible box formed of a cardboard material where the side walls are collapsible when pressure is applied to the bottom and top walls. The collapsible box is expandable to define an interior heating space when pressure is applied to a junction of a rear wall and one of the top and bottom walls and a junction of a front wall and the other of the top and bottom walls. This disclosed, collapsible box further includes a susceptor that is disposed on the bottom wall and on a strip at the lower edges of the front, rear, and side walls. Inside the collapsible container is a quantity of cooking oil, salt, and un-popped popcorn.

Even more recently, a collapsible box incorporating a susceptor pouch has been developed, in which the collapsible box employs a "susceptor pouch," as opposed to a susceptor integrated with the box walls. The use of a separate susceptor pouch, which is not integrated into the box walls, provides flexibility in manufacturing and shipping as well as avoiding some of the problems mentioned above. However, this container also has its drawbacks. Particularly, this container could be very hot to the touch after cooking, has a tendency to leak through the bottom corners of the box, and does not satisfactorily "lock" into its expanded configuration.

While the aforementioned microwave cooking containers generally work for their intended purpose, they have not addressed the need for an improved, collapsible microwave cooking container that is relatively economical to manufacture, i.e., a container that eliminates the need and costs associated with providing extra leak containing elements. A need also remains for a collapsible microwave cooking container that has improved "locking" characteristics for use during the expansion process. A still further need remains for a collapsible microwave cooking container having a means for allowing the heated container to be more easily removed from the microwave oven. Yet another need exists for a collapsible microwave cooking container which minimizes venting to, in turn, optimize pop volume of to-be-cooked popcorn.

These and other objects of the invention are addressed in the specification, claims and drawings of the present application.

SUMMARY OF THE INVENTION

To address these and other needs in the art, the following describes a collapsible cooking container formed from a generally, rectangularly shaped paperboard blank folded along crease lines so as to have a bottom portion, a first side portion, a top portion, and a second side portion wherein the top portion and the first side portion are adapted to be attached to form a cube having opposed, open sides. The opposed, open sides are substantially covered when the collapsible cooking container is in an expanded configuration by segments provided to the bottom portion, first and second side portions, and top portion that cooperate to form first and second collapsible sides. For generally providing the collapsible cooking container with improved resistance to leakage, webbed bottom corners may be provided that function to contiguously integrate the lower sections of the first and second side portions and the segments forming the collapsible side walls about the full perimeter of the bottom portion of the collapsible cooking container. For generally providing the collapsible cooking container with improved "locking" characteristics for use during the expansion process, the segments extending from the bottom portion and the top portion may be provided with first locking tabs such that an exterior surface of each locking tab engages an interior surface of its opposite segment and one of the top portion or bottom portion segments is disposed within a slot formed in the other of the segments. The locking tabs may also be sized and arranged to facilitate an earlier engagement between the locking tabs and the opposed segments during the expansion process. For generally providing the collapsible cooking container with a means for allowing the heated container to be more easily removed from the microwave oven, outwardly extendable tabs may be provided to opposed sides of the collapsible cooking container.

An appreciation of these and other objects, advantages, features, properties and relationships of the subject collapsible microwave cooking container will be obtained from the following detailed description and accompanying drawings which set forth illustrative embodiments that are indicative of the various ways in which the disclosed principles may be employed.

BRIEF DESCRIPTION OF THE DRAWINGS

For a better understanding of the collapsible microwave cooking container disclosed hereinafter, reference may be had to preferred embodiments shown in the following drawings in which.

DETAILED DESCRIPTION

Figure 1:
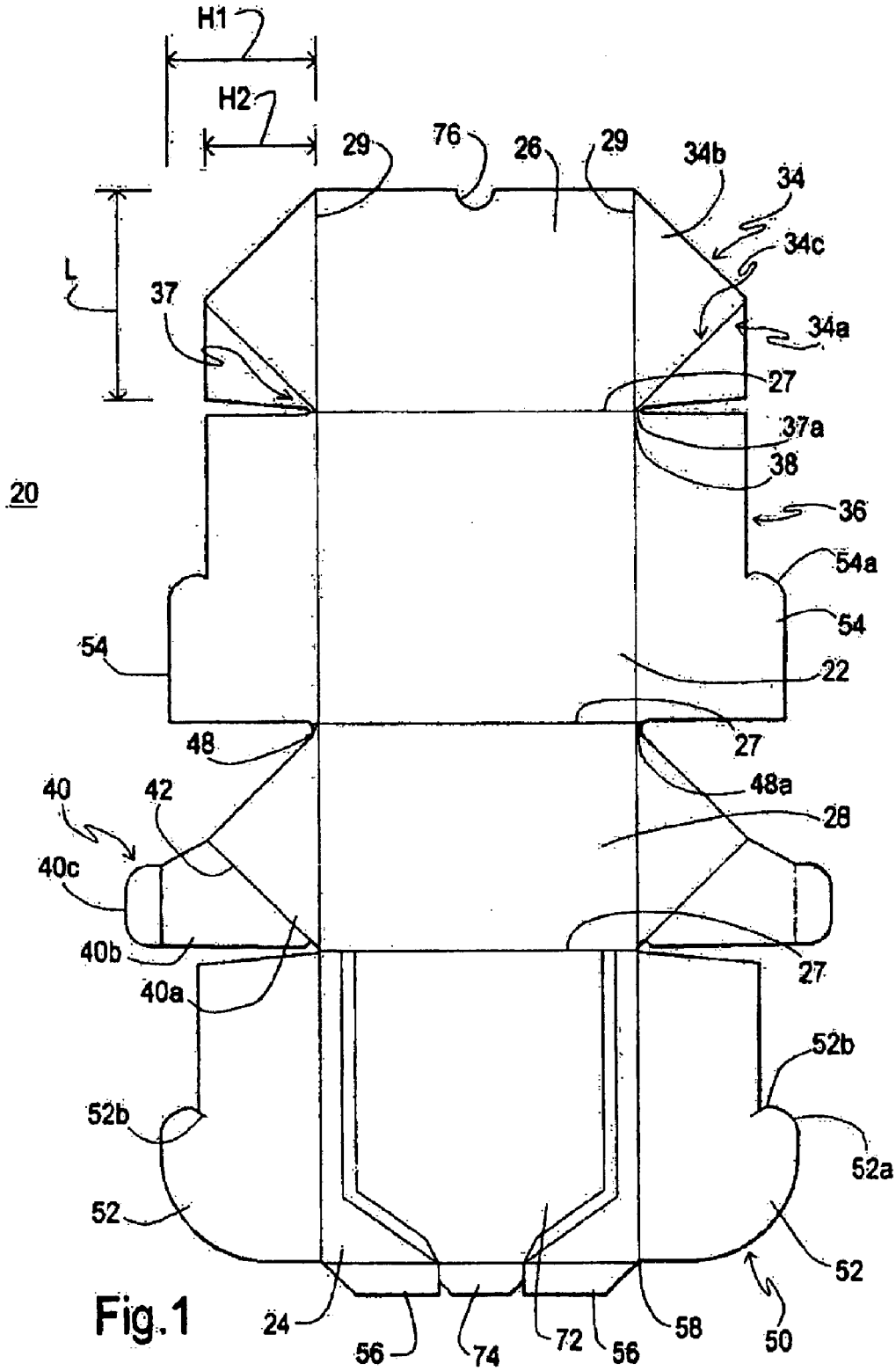
FIG. 1 illustrates a blank for forming an exemplary, collapsible microwave cooking container corresponding to the present invention.

While this invention is susceptible of embodiment in many different forms, there is shown in the drawings and will be described herein in detail, a specific embodiment, with the understanding that the present invention is to be considered an exemplification of the principals of the invention and is not intended to limit the invention to the embodiment illustrated.

With reference to the figures, the following generally discloses a collapsible microwave cooking container 10 and, more specifically, a collapsible microwave cooking container 10 for use in cooking popcorn. As will become apparent, the collapsible cooking container 10 provides a single package that is suitable for the shipping, storage, cooking, and consumption of microwave popcorn, while maximizing popping efficiency. To this end, the collapsible cooking container 10 is a six-sided box having collapsible side panels which allows the collapsible cooking container 10 to have both a shipping configuration and a serving configuration. When in the shipping configuration, the collapsible cooking container 10 is folded flat with its side panels collapsed. When in the serving configuration, the collapsible cooking container 10 is articulated into the six-sided box, with its side panels locked so as to be perpendicularly erect with respect to the top and bottom panels. Included within the collapsible cooking container 10, by being adhered to the bottom panel, is an expandable charge pouch containing popcorn. When heated by microwave energy, the expandable charge pouch will open and allow the cooking popcorn to fill the articulated, collapsible cooking container 10.

To form the collapsible cooking container 10, a blank 20 of paperboard material is first formed. By way of example, FIG. 1 illustrates a blank 20 having generally rectangular portions which define a bottom panel 22, a top panel 24, a first side panel 26, and a second side panel 28. The bottom panel 22, top panel 24, first side panel 26, and second side panel 28 are adjoined along creases 27 provided to facilitate uniform bending of the panels when forming the collapsible container 10. Further extending from opposite sides of each of the bottom panel 22, top panel 24, first side panel 26, and second side panel 28 are partial side panel segments that will cooperate to form a first collapsible side and second collapsible side, respectively, of the collapsible cooking container 10. Again, the partial side panel segments are adjoined to their respective panels along creases 29 provided to facilitate uniform bending of the partial side panel segments when forming the collapsible cooking container 10 as well as expanding/collapsing of the collapsible cooking container 10, i.e., to allow the collapsible cooking container 10 to be articulated from its shipping configuration to its serving configuration.

For use in forming the first and second collapsible sides, first side panel segments 34 are provided which laterally extend from opposing sides of the first side panel 26. The first side panel segments 34 generally comprise a first, generally triangularly shaped segment 34*a* and a second, generally triangularly shaped segment 34*b* adjoined by a crease 34*c* that is provided to facilitate uniform bending of the first, generally triangularly shaped segment 34*a* relative to the second, generally triangularly shaped segment 34*b*. Located adjacent to the first side panel segments 34 and laterally extending from opposing sides of the bottom panel 22 are generally rectangularly shaped bottom panel segments 36.

To create a substantially leak resistant corner when the collapsible cooking container 10 is formed and later articulated for cooking use, each of the first, generally triangularly shaped segment 34*a* and bottom panel segment 36 may be formed so as to cooperate to provide a webbed or gusseted corner, via upstanding gusset portion 37*a*. For this purpose, the first, generally triangularly shaped segment 34*a* may be formed so as to be adjoined to the bottom panel segment 36 along a crease 38 where the adjoined portion extends for at least a portion of the overall lateral lengths of the first, generally triangularly shaped segment 34*a* and the bottom panel segment 36. Furthermore, the termination of the adjoining of the first, generally triangularly shaped segment 34*a* to the bottom panel segment 36 may be by means of a separation that provides an arcuate corner 37 at the termination location, adjacent gusset portion 37*a*.

Further extending from opposing sides of the second side panel 28 and located adjacent to the bottom panel segments 36 are second side panel segments 40. The second side panel segments 40 comprise a generally triangularly shaped segment 40*a* which is adjoined to second side panel 28 along crease 29. Adjoined to a side of the generally triangularly shaped segment 40*a*, proximate to top panel segment 50, along a diagonal crease 42, is a first, generally rectangularly shaped segment 40*b*. Further adjoined to the first, generally rectangularly shaped segment 40*b* and bendable with respect thereto by means of a crease 44, is a second, generally rectangularly shaped segment 40*c*. The second, generally rectangularly shaped segment 40*c* will be seen to provide extendable tabs by which the collapsible cooking container 10 may be withdrawn from a microwave oven after cooking.

For again creating a substantially leak resistant corner when the collapsible cooking container 10 is formed and later articulated for cooking use, each of the generally triangularly shaped segment 40*a* and bottom panel segment 36 may be formed so as to cooperate to provide a webbed corner. For this purpose, the generally triangularly shaped segment 40*a* may be formed so as to be adjoined to the bottom panel segment 36 along upstanding web portion 48*a*, which extends for at least a portion of the overall lateral lengths of the generally triangularly shaped segment 40*a* and the bottom panel segment 36. Furthermore, the termination of the adjoining of the generally triangularly shaped segment 40*a* to the bottom panel segment 36 may be by means of a separation that provides an arcuate corner 48 at the termination location, to create upstanding web portion 48*a*.

Finally, positioned adjacent to the second side portion segments 40 and laterally extending from opposed sides of the top panel 24 are generally rectangular top panel segments 50.

Figure 2:
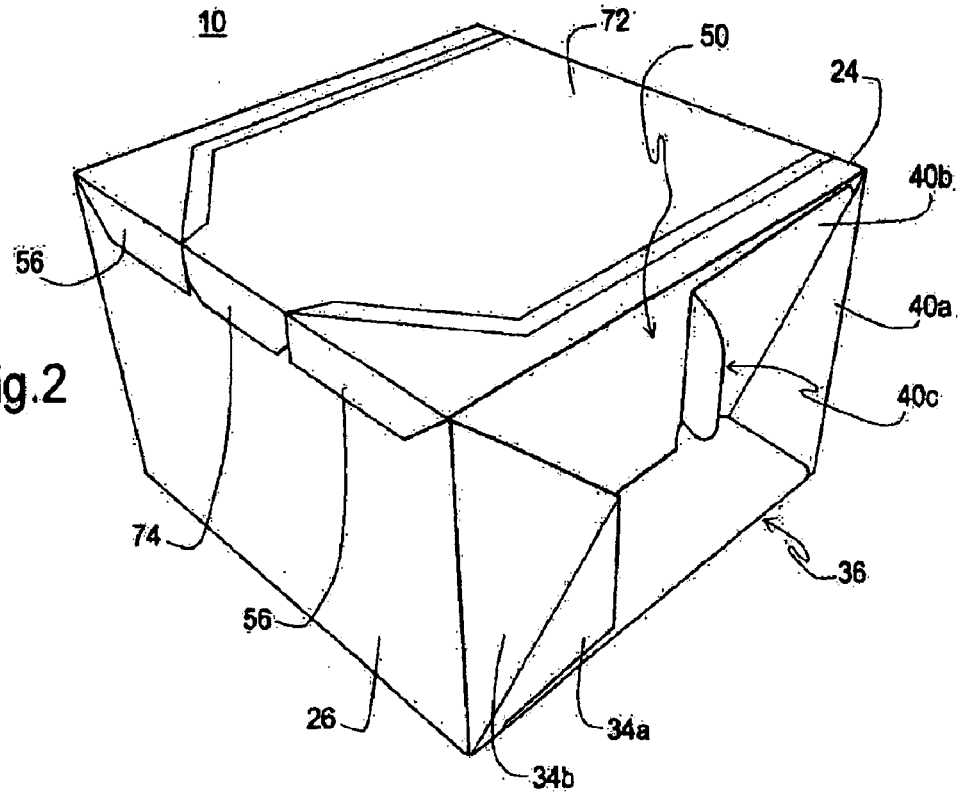
FIG. 2 illustrates a perspective view of the exemplary, collapsible microwave cooking container in an expanded configuration.
Figure 3:
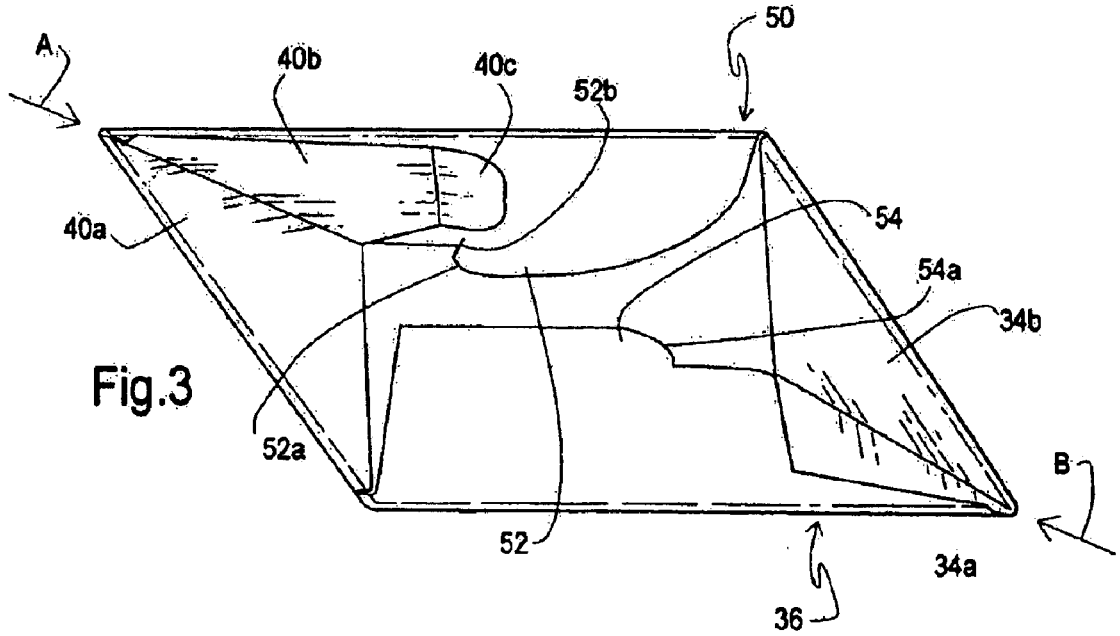
FIG. 3 illustrates a side view of the exemplary, collapsible microwave cooking container in a partially collapsed configuration.

To create the collapsible cooking container 10 from the blank 20, the top portion 24 is provided with tabs 56 that are bendable along crease lines 58 so as to be adhered to the exterior side of the first side portion 26, as illustrated in FIG. 2. Furthermore, as illustrated in FIGS. 2 and 3, the interior side of the first, generally triangularly shaped segment 34*a* of each of the first side panel segments 34 is placed in overlapping relation with the exterior of a corresponding one of the bottom panel segments 36 and adhered thereto. Finally, the interior side of the generally triangular shaped segment 40*b* of each of the second side panel segments 40 is placed in overlapping relation with the exterior of a corresponding one of the top panel segments 52 and adhered thereto. As will be appreciated, the webbed or gusseted corners resulting from the manner in which the bottom portion segments 36 are adjoined to the first and second side portion segments 26,28 provides a contiguous surface that extends partially upwardly from the perimeter of the bottom portion 22 to thereby prevent leakage from the lower corners of the collapsible cooking container 10. Particularly upstanding webbed/gusseted portions 37*a* and 48*a* function to prevent leaks. It will be further appreciated that adhering one element to another may be accomplished through the use of an adhesive that is conventionally used when constructing containers that are to be inserted into a microwave oven.

To articulate the collapsible cooking container 10 from its shipping configuration (i.e., collapsed) to its serving configuration (i.e., expanded), the collapsible cooking container 10 is preferably pushed inward at is corners along line A and line B which are illustrated in FIG. 3. The collapsible cooking container 10 may also be expanded by means of the expanding volume popcorn and steam as the popcorn is cooked. In either case, during the expansion of the collapsible cooking container 10, the first side panel segment 34, bottom panel segment 36, second side panel segment 40, and top panel segment 50, of which the first and second collapsible sides are comprised and which are inwardly bent when the collapsible cooking container 10 is in its shipping configuration, will be moved outwardly and toward one another. In particular, as these segments are moved toward one another, the interior of the generally triangularly shaped segment 40*a* of the second side panel segment 40 will be caused to overlap the exterior of the bottom portion segment 36 while the interior of the second, generally triangularly shaped segment 34*b* of the first side panel segment 34 will be caused to overlap the exterior of the top portion segment 50.

For facilitating the locking of the collapsible side walls of the collapsible cooking container 10 during the expansion process so as to maintain the collapsible cooking container 10 in its serving configuration, the top panel segments 50 and the bottom panel segments 36 are preferably provided with locking tabs. More specifically, as seen in FIG. 2, during the expansion process the top panel segment locking tab 52 will be moved to a position that is to the interior of and behind a portion of the bottom portion segment 36 opposite the bottom panel locking tab 54 while the bottom panel segment locking tab 54 will be moved to a position that is to the interior of and behind a portion of the top portion segment 50 opposite the top panel segment locking tab 52. Ease of movement of the top panel segment locking tab 52 past the bottom panel segment locking tab 54 may be facilitated by providing the top panel locking tab 52 and the bottom panel locking tab 54 with arcuate portions 52*a* and 54*a*, respectively, that will function to prevent the locking tabs 52, 54 from binding as they move past one other during the expansion process. For use in maintaining engagement between the overlapped bottom segment 36 and top segment 52, the arcuate portions 52*a* of the locking tap 52 of the top portion segment 50 may terminate in a slit 52*b* that is adapted to receive and engage the bottom portion segment 36 when the collapsible side panels are in their expanded configuration. In this regard, the slit 52*b* is preferably positioned adjacent an acute angle that is formed when the arcuate portion 52*a* of the locking tab 52 meets the remainder of the top portion segment 50.

From the foregoing, it is seen that the overlapping locking tabs 52,54 function to improve the seal on the collapsible side walls while also minimizing venting from the interior of the collapsible cooking container 10. This, in turn, will optimize the pop volume of the to-be-cooked popcorn. Relatively early engagement of the locking tabs 52,54 of the first and second side panels may also be facilitated by providing the locking tabs 52,54 with a height H1 that is approximately 67 percent of the overall height of the expanded, collapsible box 10, which would be defined by the length L of the side panel portions 26,28 (e.g., approximately 3 inches for H and approximately 4.5 inches for L). As will be readily appreciated, the height H2 of the remainder of the side portion segments 36,50 is approximately 50 percent of the overall height of the expanded, collapsible box 20 such that, when the lockable tabs 52,54 are overlapped by the remainder of the side portion segments 36,50 in the serving configuration of the collapsible cooking container 10, the combined areas of the side portion segments 36,50 functions to effectively seal the sides of the expanded collapsible cooking container 10, participating in this sealing function are web portions 37*a* and a gusset portion 48*a* which serve to block the migration of fluids at their respective articulated corners.

Figure 4:
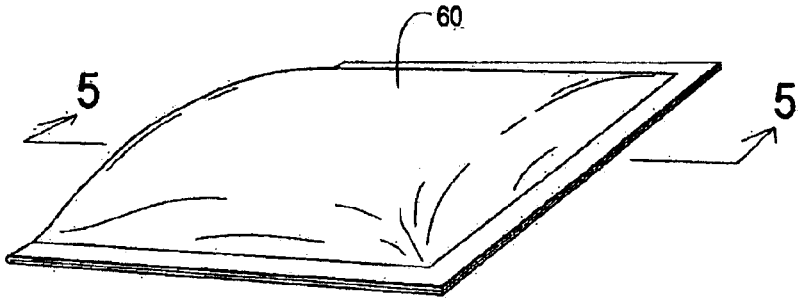
FIG. 4 illustrates an exemplary charge pouch to be included within the exemplary, collapsible microwave cooking container.
Figure 5:
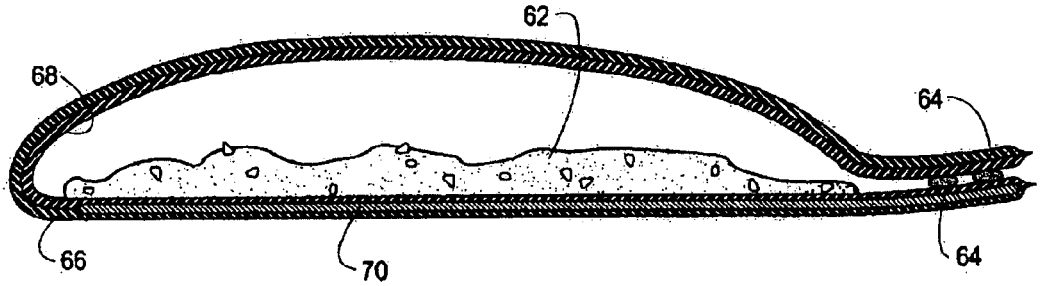
FIG. 5 illustrates a cross-sectional view of the exemplary charge pouch of FIG. 4 along line A—A thereof.
Figure 6:
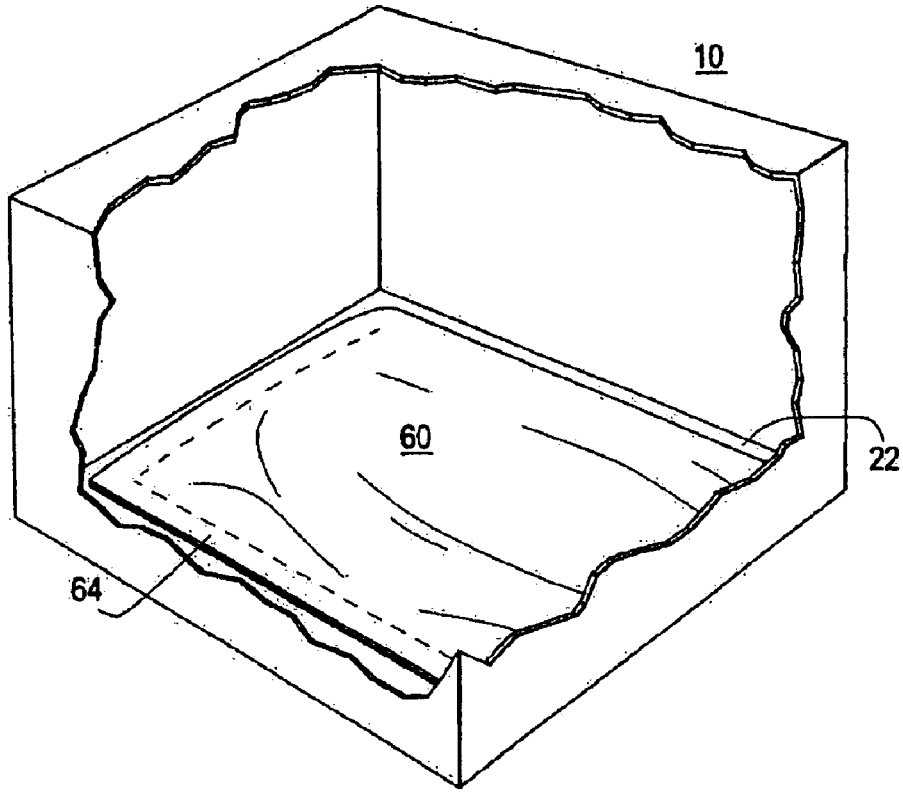
FIG. 6 illustrates the pouch of FIGS. 4 and 5 in position within the microwave cooking container prior to cooking and expansion.

During the manufacture process, an expandable charge pouch 60 is preferably attached to the bottom panel 22 prior to the folding of the collapsible cooking container 10. Preferably, the bag is attached to the bottom of the container by an adhesive material, as shown in FIG. 6. As particularly illustrated in FIGS. 4 and 5, the expandable charge pouch 60 may be comprised of a charge 62, i.e., popcorn, fat/oil, salt, seasoning, etc., that is placed on a first half of a sheet of multi-ply material with the second half of the sheet of multi-ply material being folded over the charge 62. The overlapping sheets of multi-ply material may then be sealed using a heat-releasable seal 64 that is applied along the three open edges of the folded sheet. The multi-ply material preferably includes a first ply of base material 66 and a second ply 68 of substantially moisture-proof, grease-proof, and oxygen-proof material. In addition, the first half of the multi-ply sheet, which forms the bottom of the expandable charge pouch 60, preferably includes a metallic susceptor layer 70 that is positioned between the first ply 66 and the second ply 68. During use, the metal susceptor layer will function to heat, and pop, the popcorn. Meanwhile the steam and heat released by the contents of the charge pouch 60 will cause the heat-releasable seal 64 to release to thereby allow the second half of the sheet of multi-ply material to separate from the first half of the sheet of multi-ply material. The popcorn kernels are thus able to expand into the full volume of the collapsible cooking container 10 as they pop.

Figure 7:
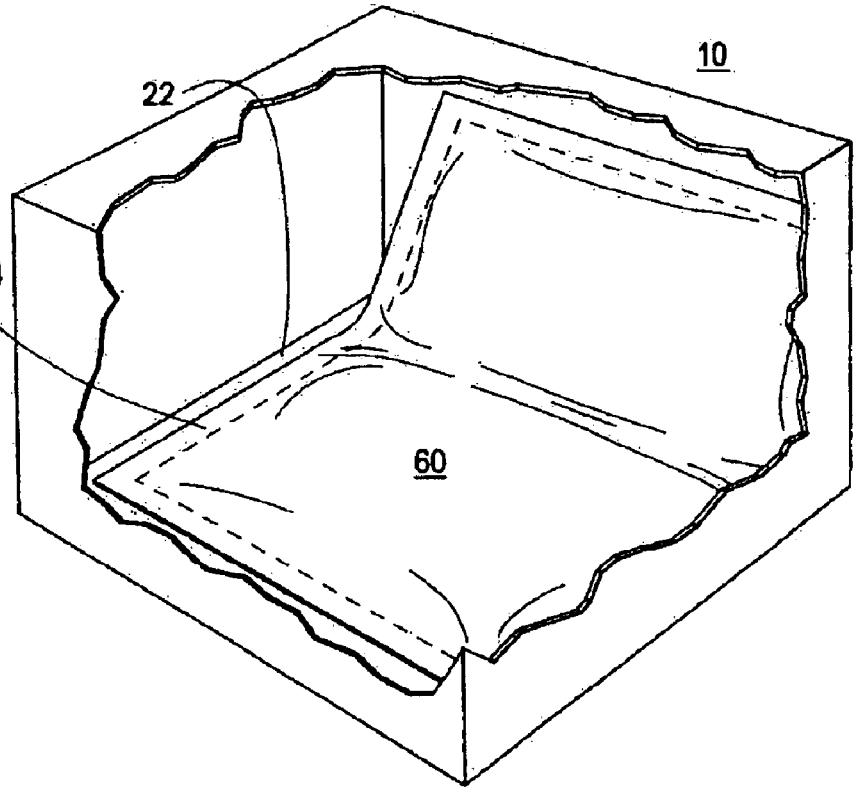
FIG. 7 illustrates the condition of the pouch within the microwave cooking container after cooking and expansion.

The placement of charge pouch 60 is better shown in FIG. 6, when charge pouch 60 is located at the approximate center of bottom panel 22 of cooking container 10, which is shown in its expanded configuration. Likewise, FIG. 7 illustrates the configuration of the charge pouch 60 once the heat-releasable seal 64 has been released.

Once the popcorn has been heated within the microwave oven, removal of the heated collapsible cooking container 10 may be accomplished utilizing the tabs that are formed by outwardly bending the second, generally rectangularly shaped segments 40*c* of the second side segments 40, as illustrated in FIG. 2. Preferably, the tabs are bent outward prior to insertion of the collapsible cooking container 10 into the microwave oven. As will be appreciated, the tabs provide a convenient means for removal of the collapsible cooking container 10 so as to avoid direct contact with the body of the collapsible cooking container 10 which will be at an elevated temperature due to the heated popcorn contained therein.

For use in accessing the interior of the expanded, collapsible cooking container 10, and the cooked popcorn, the top portion 24 may be provided with a lid 60 that is pivotable along the crease 29 that adjoins the top portion 24 to the second side portion 28. The lid 72 may be defined by being partially pre-cut from the top portion 24, i.e., by forming lines of weakness in the top portion 24. The pivoting separation of the lid 72 from the top portion 24 may be performed using a lid lifting tab 74 that may be provided to an end of the lid 72 opposite its pivoting point of adjoinment to the remainder of collapsible cooking container 10. The lid lifting tab 74 may be attached to the lid 74 be means of a crease 76 to thereby allow the lid lifting tab 74 to be bent so as to generally overlap the first side portion 26 prior to the need for its use. An opening for inserting a finger under the lid 74 to allow for a better grip to separate the lid 74 from the top portion 24 may be additionally provided by forming an arcuately shaped notch 76 in a side of the first side portion 26 which will be adjacent to the lid 74 when the collapsible cooking container 10 is formed.

Thus, a microwave cooking container has been described and illustrated which, among other things, is relatively more economical to manufacture, has improved "locking" characteristics for use during the expansion process, has a means for allowing the heated container to be more easily removed from the microwave oven, and/or which minimizes venting to, in turn, optimize pop volume of to-be-cooked popcorn. However, while specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. A collapsible microwave cooking container, comprising:

a generally, rectangularly shaped paperboard blank folded along crease lines to form a bottom portion, a first side portion, a top portion, and a second side portion wherein said top portion and said first side portion are adapted to be attached so as to form a cube having opposed, open sides; and a first collapsible side and a second collapsible side each adapted to substantially cover one of said opposed, open sides of said cube when said collapsible microwave cooking container is in an expanded configuration;

wherein each of said first collapsible side and said second collapsible side comprise a first generally rectangularly shaped segment laterally extending from said bottom portion and having a first radiused locking tab adjoining said first segment, a second generally rectangularly shaped segment laterally extending from said top portion and having a second radiused locking tab adjoining said second segment, and a locking tab slot disposed at the intersection of at least one of the first and second radiused locking tabs and the corresponding one of the first and second generally rectangularly shaped segments, respectively, such that when said collapsible microwave cooking container is in said expanded configuration, said collapsible microwave container is generally maintained in said expanded configuration as an exterior surface of said first locking tab engages an interior surface of said second generally rectangularly shaped segment and an exterior surface of said second locking tab engages an interior surface of said first generally rectangularly shaped segment and said top portion and one of said first and second generally rectangularly shaped segments is disposed within a the locking tab slot formed in the other of said first and second generally rectangularly shaped segments.

2. The collapsible microwave cooking container as recited in claim 1, wherein said second generally rectangularly shaped segment has said locking tab slot.

3. The collapsible microwave cooking container as recited in claim 2, wherein said locking tab slot is positioned adjacent said second locking tab.

4. The collapsible microwave cooking container as recited in claim 3, wherein said second radiused locking tab has an arcuate end portion and said arcuate end portion forms an acute angle between said second locking tab and said second generally rectangularly shaped segment.

5. The collapsible microwave cooking container as recited in claim 3, wherein said first and second radiused locking tabs of said first and second generally rectangularly shaped segments extend to a height that is at least sixty-seven percent of a height provided to the first and second side portions.

6. The collapsible microwave cooking container as recited in claim 1, wherein a charge pouch is attached to the bottom portion.

7. The collapsible microwave cooking container as recited in claim 6, wherein the charge pouch includes un-popped popcorn.

8. A collapsible microwave cooking container;

a generally, rectangularly shaped paperboard blank folded along crease Lines to form a bottom portion, a first side portion, a top portion, and a second side portion wherein said top portion and said first side portion are adapted to be attached so as to form a cube having opposed, open sides; and a first collapsible side and a second collapsible side each adapted to substantially cover one of said opposed, open sides of said cube when said collapsible microwave cooking container is in an expanded condition;

wherein each of said first collapsible side and said second collapsible side comprise an outwardly extendable tab for use in removing said collapsible microwave cooking container from a microwave oven after heating.

9. The collapsible microwave cooking container as recited in claim 8, wherein said first and second collapsible sides are formed by cooperating, bendable segments provided to opposed sides of each of said top portion, bottom portion, and first and second side portions and wherein said segments provided to the top portion comprise said outwardly extendable tab.

10. A collapsible microwave cooking container, comprising:

a generally, rectangularly shaped paperboard blank folded along crease lines to form a bottom portion, a first side portion, a top portion, and a second side portion wherein said top portion and said first side portion are adapted to be attached so as to form a cube having opposed, open sides; and a first collapsible side and a second collapsible side each adapted to substantially cover one of said opposed, open sides of said cube when said collapsible microwave cooking container is in an expanded condition;

wherein said first and second collapsible sides are formed by cooperating, bendable segments provided to opposed sides of each of said top portion, bottom portion, and first and second side portions and wherein said bendable segments provided to said first and second side portions cooperate with said bendable segments provided to said bottom portion to contiguously integrate upwardly extending sections of said first and second side portions and said collapsible sides about a perimeter of said bottom portion for reducing leakage from said collapsible microwave cooking container when said collapsible microwave cooking container is in said expanded condition, and wherein at least one of said bendable segments provided to said first and second side portions cooperates with at least one of said bendable segments provided to said bottom portion to form an arcuate corner.

11. The collapsible microwave cooking container as recited in claim 10, wherein a length of each of said segments provided to said first side portion are adjoined to a length of a corresponding one of said segments provided to said bottom portion.

12. The collapsible microwave cooking container as recited in claim 10, wherein a length of each of said segments provided to said second side portion is adjoined to a length of a corresponding one of said segments provided to said bottom portion.

13. The collapsible microwave cooking container as recited in claim 11, wherein each of said segments provided to said first side portion and said corresponding one of said segments provided to said bottom portion are arranged to form an arcuate corner.

14. The collapsible microwave cooking container as recited in claim 12, wherein each of said segments provided to said second side portion and said corresponding one of said segments provided to said bottom portion are arranged to form an arcuate corner.

15. A collapsible microwave cooking container comprising:

a generally rectangular shaped paperboard blank folded along crease lines to form a bottom portion, a first side portion, a top portion, and a second side portion, wherein said top portion and said first side portion are adapted to be attached so as to form a cube having opposed, open sides; and a first collapsible side and a second collapsible side each adapted to substantially cover one of said opposed, open sides of said cube when said collapsible microwave cooking container is in an expanded configuration, wherein at least one of said first collapsible side and said second collapsible side comprises:

a generally rectangularly shaped segment laterally extending from one of said bottom portion and said top portion;

a radiused locking tab adjoining said generally rectangularly shaped segment; and a locking tab slot disposed at the intersection of said radiused locking tab and said generally rectangularly shaped segment.

* * * * *